US008494755B2

(12) United States Patent
Kaas et al.

(10) Patent No.: US 8,494,755 B2
(45) Date of Patent: Jul. 23, 2013

(54) APPARATUS AND METHOD FOR CONTROLLING THE SPEED OF AN INTERNAL COMBUSTION ENGINE

(75) Inventors: Tom Kaas, Solf (FI); Tom Troberg, Vasa (FI); Johan Pensar, Vaasa (FI)

(73) Assignee: Wartsila Finland Oy, Vaasa (FI)

( * ) Notice: Subject to any disclaimer, the term of this patent is extended or adjusted under 35 U.S.C. 154(b) by 219 days.

(21) Appl. No.: 13/139,897

(22) PCT Filed: Dec. 15, 2009

(86) PCT No.: PCT/FI2009/051001

§ 371 (c)(1),
(2), (4) Date: Jun. 15, 2011

(87) PCT Pub. No.: WO2010/076381

PCT Pub. Date: Jul. 8, 2010

(65) Prior Publication Data

US 2011/0247588 A1 Oct. 13, 2011

(30) Foreign Application Priority Data

Dec. 31, 2008 (FI) ..... 20086254

(51) Int. Cl.
*F02D 41/14* (2006.01)

(52) U.S. Cl.
USPC ..... 701/104; 701/107; 701/111; 123/352; 123/479; 123/690

(58) Field of Classification Search
USPC ..... 701/104, 107, 111; 123/350, 352, 123/479, 690
See application file for complete search history.

(56) References Cited

U.S. PATENT DOCUMENTS

| | | | | |
|---|---|---|---|---|
| 4,669,436 | A | 6/1987 | Nanjyo et al. | |
| 4,718,016 | A * | 1/1988 | Sudo | 701/110 |
| 5,331,559 | A | 7/1994 | High et al. | |
| 5,553,589 | A | 9/1996 | Middleton et al. | |
| 6,092,504 | A * | 7/2000 | Barnes et al. | 123/357 |
| 6,289,873 | B1 | 9/2001 | Dunsworth | |
| 6,839,619 | B2 * | 1/2005 | Bellinger | 701/103 |
| 7,430,483 | B2 * | 9/2008 | Wiig | 702/69 |
| 7,536,992 | B1 * | 5/2009 | Wieshuber et al. | 123/352 |
| 8,126,638 | B2 * | 2/2012 | Adachi et al. | 701/107 |

FOREIGN PATENT DOCUMENTS

| | | | |
|---|---|---|---|
| DE | 102005010435 | A1 | 9/2006 |
| EP | 1686250 | | 8/2006 |
| EP | 1686250 | A2 | 8/2006 |
| GB | 2165065 | | 4/1986 |
| GB | 2165065 | A | 4/1986 |
| WO | WO-95/23921 | | 9/1995 |

* cited by examiner

*Primary Examiner* — Erick Solis
(74) *Attorney, Agent, or Firm* — Muncy, Geissler, Olds & Lowe, PLLC

(57) ABSTRACT

The apparatus according to the invention comprises a controller for forming a speed signal arranged to receive speed measurement data of the internal combustion engine as well as speed reference data. The apparatus additionally comprises a module for forming the internal speed reference value instead of the speed reference value set to be used when forming the control signal.

6 Claims, 3 Drawing Sheets

APPARATUS AND METHOD FOR CONTROLLING THE SPEED OF AN INTERNAL COMBUSTION ENGINE

FIELD OF INVENTION

The present invention relates to speed control of internal combustion engines.

BACKGROUND ART

FIG. 1 illustrates the usual method of controlling the speed of an internal combustion engine. The control is carried out in a main control module 1 responsible for the speed control of the whole engine. The main control module calculates the total fuel requirement of the engine. The total fuel requirement data is sent to cylinder control modules 2. The cylinder control module sets the duration of fuel injection for the cylinders being controlled by the module. As can be seen from the figure, the speed of the shaft 3 of the internal combustion engine is measured by means of a speed sensor 4. Using the design of FIG. 1 the amount of fuel received by the cylinders of the engine can be controlled so that all cylinders receive approximately the same amount of fuel and thus they also evenly share the load of the engine.

FIG. 2 illustrates a situation in which there is a problem in the data communication between the main control module 1 and the cylinder control modules 2. In this case data of the engine 14 total fuel requirement cannot be transferred to the cylinder control modules. If the engine speed data were transferred directly to each cylinder control module, cylinder control module specific connections to the speed sensor would be necessary. FIG. 2 illustrates another speed sensor 5 and the connections between it and the cylinder control modules for exemplifying such a design. However, the problem is that now it is not possible to make sure that each cylinder gets approximately the same amount of fuel. Even though the cylinder control modules use the same speed reference, they are independent and they do not communicate together. As the speed measurement data can vary between cylinders and the cylinder control modules are not synchronized, the amount of fed fuel starts to fluctuate between the cylinder control modules. The end result is that some cylinders bear the whole load of the engine, i.e. a large amount of fuel is introduced thereto, while other cylinders are not fed fuel at all. Thus, some cylinders can be overloaded, which can cause engine damage.

BRIEF DESCRIPTION OF THE INVENTION

The aim of the invention is to produce a method and an apparatus for eliminating or at least reducing the disadvantages of the above-mentioned problems. The aim is achieved by means of a method according to claim 1 and an apparatus according to claim 6.

The method of controlling the speed of an internal combustion engine according to the invention comprises the steps of: measuring speed of the internal combustion engine, forming an internal speed reference value by using control signal data for using in place of the set speed reference data when forming the control signal, and forming a control signal as a response to the measurement as well as to the internal and set speed reference value.

The step of forming the internal speed reference value comprises a function for reducing the effect of the set reference value in the internal speed reference value by subtracting from the set reference value the part depending on the value of the control signal by certain criteria.

The apparatus according to the invention for controlling speed of the internal combustion engine comprises a controller for forming a speed signal arranged to receive speed measurement data of the internal combustion engine as well as speed reference data. The apparatus additionally comprises a module for forming an internal speed reference value to be used in place of the set speed reference value when forming the control signal, the module being arranged to use the set speed reference value and control signal data for forming the internal speed reference value.

The module comprises a submodule for reducing the effect of the set reference value in the internal speed reference value, the submodule being arranged to subtract a certain part of the set reference value, the part being dependent on the value of the control signal under certain criteria.

LIST OF FIGURES

In the following the invention is described in more detail by reference to the figures in the drawings, in which FIG. 1 is an example of a known arrangement for controlling speed of an internal combustion engine, FIG. 2 is an example of a fault situation in the speed control system of an internal combustion engine, FIG. 3 is an example of the speed control system of an internal combustion engine according to the invention, FIG. 4 is an example of reducing effect of the set reference value according to the invention, FIG. 5 illustrates an example of the method according to the invention.

Figure 1:
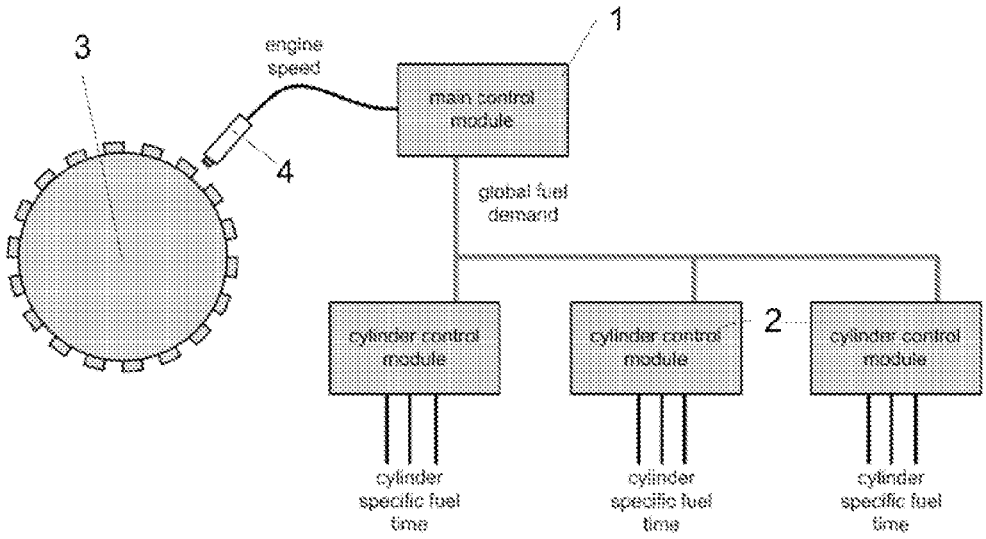
FIG. 1 PRIOR ART
Figure 2:
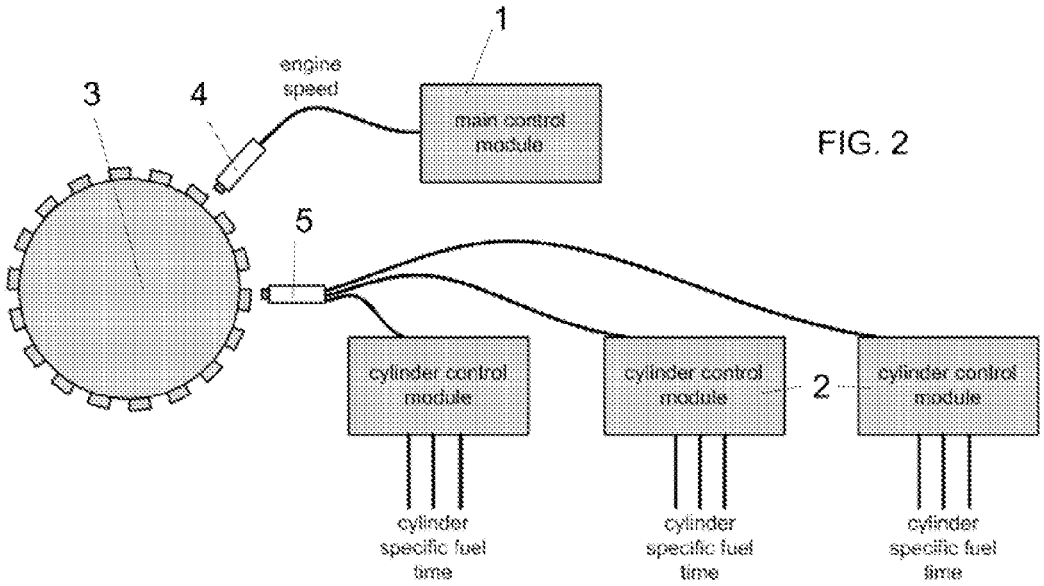
Figure 3:
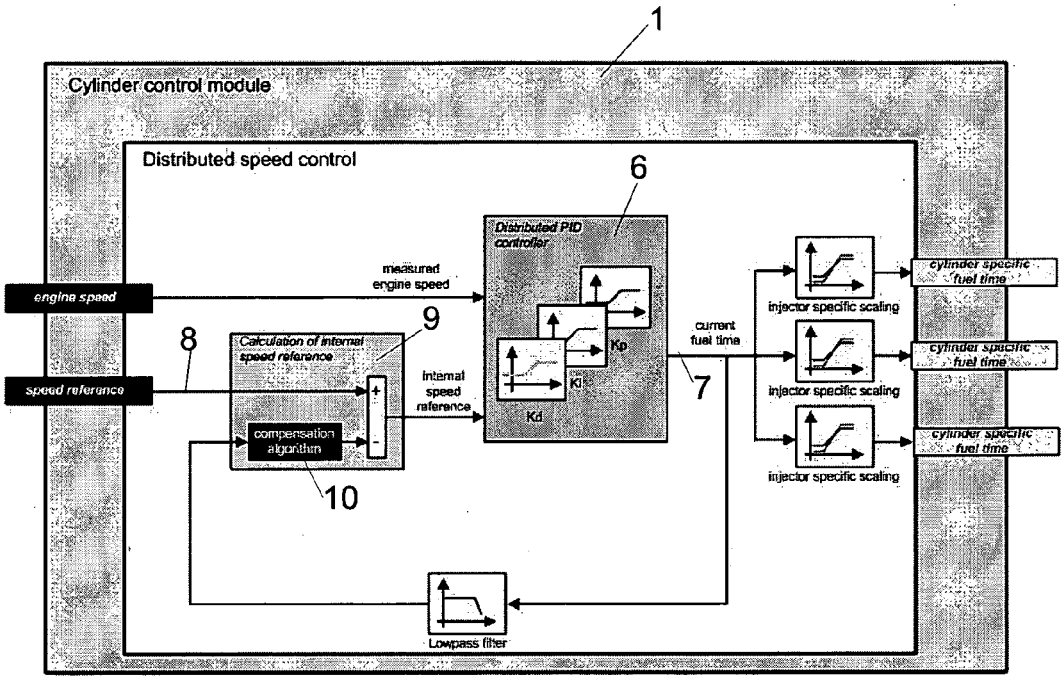
FIG. 3 is an example of a solution in which the cylinder control module is provided with a function for reducing the effect of the set reference value 8 in the control signal to be formed. As is known, the cylinder control module comprises a controller 6 forming a speed signal as a response to the speed measurement data and the set speed reference. The control signal 7 represents the duration of the injection to the cylinder. The control signal is sent to the cylinders controlled by the cylinder control module. If necessary, the control signal can be set cylinder-specifically.

The effect of the set reference value 8 can be reduced by subtracting a certain part from it. The remaining part forms an internal reference value 110 which the controller 6 uses instead of the set reference value. The subtracted part 100 is formed by using current control signal data 7. The control signal data can be filtered in a low-pass filter 20 before it is used.

One embodiment is that the cylinder control module 1 comprises a subtraction module 9 comprising a sub-module 10 for reducing the effect of the set reference value in the internal speed reference value. The sub-module is arranged to reduce a certain part of the set reference value, the part being dependent on the value of the control signal under certain criteria.

The said modules can be carried out with software or by means of e.g. an ASIC card (Application Specific Integrated Circuit) or by using another suitable realization method. The modules can also be a part of a larger integrated unit either physically or in software.

Figure 4:
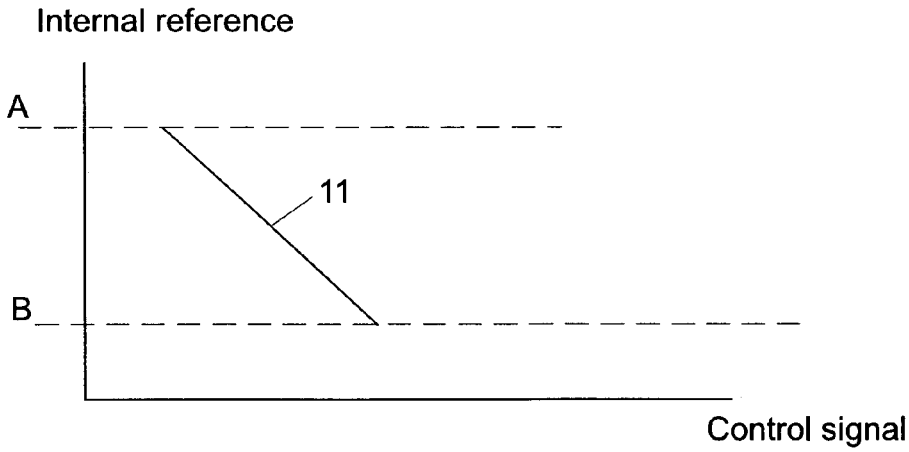

FIG. 4 shows an example of this principle. Level A corresponds to 0% of the possible control signal value. Curve 11 shows an internal reference value. When the amount of the control signal increases, internal reference value decreases. Level B corresponds to 100% of the possible control signal value.

In practice the part to be subtracted from the set reference value can be arranged to be formed by multiplying the set speed reference value with the control signal value and a certain coefficient. The coefficient can be formed by using integers, multiplication and division.

Figure 5:
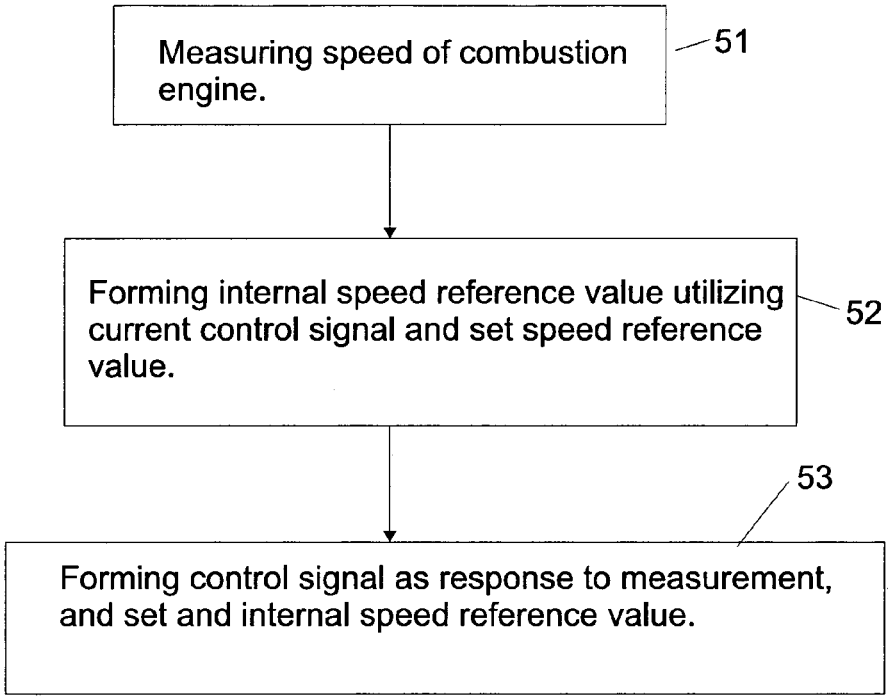

FIG. 5 shows an example of the method. The method comprises the steps of measuring 51 speed of the internal combustion engine, forming 52 an internal speed reference value by using control signal data, for using in place of the speed reference data when forming the control signal and forming 53 a control signal as a response to the measurement and to the internal and set speed reference value.

As can be seen form the above the method makes it possible to use the internal reference value instead of the set reference value in the controller part 6.

The step of forming the internal speed reference value comprises a function for reducing the effect of the set reference value in the internal speed reference value by subtracting from the set reference value the part depending on the value of the control signal by certain criteria. See FIG. 4. In practice the part to be subtracted from the set reference value can be arranged to be formed by multiplying the set speed reference value with the control signal value and a certain coefficient. The coefficient can be formed by using integers with multiplication and division. As has been described above, the control signal to be formed represents the duration of the fuel injection of the cylinder.

As can be seen, the embodiment according to the invention can be carried out by means of a number of solutions. Thus, it will be apparent that the invention is not limited to the examples mentioned in this text.

Thus, any inventive embodiment can be carried out within the scope of the invention.

The invention claimed is:

1. A method of controlling the speed of an internal combustion engine, comprising steps of:

measuring speed of the internal combustion engine and forming a control signal as a response to the measurement and a set speed reference value, wherein the method also comprises a step of forming an internal speed reference value by utilizing the control signal, for using when forming the control signal, the step of forming the internal speed reference value comprising a function to subtract from the set reference value a subtraction part that depends on the value of the control signal, which subtraction part is arranged to be formed by multiplying the set speed reference value, the control signal value and a coefficient.

2. The method according to claim 1, wherein the control signal represents the duration of the fuel injection of the cylinder.

3. An apparatus for controlling speed of an internal combustion engine, the apparatus comprising a controller for forming a control signal, the apparatus and the controller being arranged to receive speed data of the internal combustion engine and the apparatus being arranged to receive a set speed reference value, wherein the apparatus also comprises a module for forming an internal speed reference value for using when forming the control signal by the controller as response to the received speed data and the internal speed reference value, the module being arranged to use the set speed reference value and the control signal value for forming the internal speed reference value, the module comprising a submodule, the submodule being arranged to subtract a subtraction part of the set reference value, the part being dependent on the value of the control signal, which subtraction part is arranged to be formed by multiplying the set speed reference value, the control signal value and a coefficient.

4. The apparatus according to claim 3, wherein the control signal represents the duration of the fuel injection of the cylinder.

5. The apparatus according to claim 3, wherein the apparatus is a cylinder controller module.

6. The apparatus according to claim 3, wherein the control signal is arranged to be processed in a low-pass filter prior to its use in the module.

* * * * *